US011802447B2

(12) United States Patent
Smith

(10) Patent No.: US 11,802,447 B2
(45) Date of Patent: Oct. 31, 2023

(54) DRILLING RIG WITH DRAWWORKS PROXIMATE TO THE OPERATING SIDE OF THE MAST

(71) Applicant: Entro Industries, Inc., Hillsboro, OR (US)

(72) Inventor: Shawn R. Smith, Hillsboro, OR (US)

( * ) Notice: Subject to any disclaimer, the term of this patent is extended or adjusted under 35 U.S.C. 154(b) by 0 days.

(21) Appl. No.: 17/320,093

(22) Filed: May 13, 2021

(65) Prior Publication Data

US 2021/0355763 A1 Nov. 18, 2021

Related U.S. Application Data

(60) Provisional application No. 63/025,821, filed on May 15, 2020.

(51) Int. Cl.

| | |
|---|---|
| ***E21B 19/00*** | (2006.01) |
| ***E21B 7/02*** | (2006.01) |
| ***E21B 15/00*** | (2006.01) |
| ***E21B 19/15*** | (2006.01) |
| ***E21B 19/02*** | (2006.01) |

(52) U.S. Cl.

CPC ..... *E21B 19/008* (2013.01); *E21B 7/02* (2013.01); *E21B 15/00* (2013.01); *E21B 19/02* (2013.01); *E21B 19/155* (2013.01)

(58) Field of Classification Search

CPC ..... E04H 12/182; E04H 12/34; E04H 12/10; E04H 12/345; E21B 15/00; E21B 7/02; E21B 15/003; E21B 19/008; E21B 19/02; E21B 19/155; B66D 3/08

See application file for complete search history.

(56) References Cited

U.S. PATENT DOCUMENTS

| | | | | |
|---|---|---|---|---|
| 2,505,087 | A * | 4/1950 | Athy | E21B 15/00 52/120 |
| 2,966,994 | A * | 1/1961 | Wolff | E21B 15/00 175/85 |
| 4,290,495 | A * | 9/1981 | Elliston | E21B 19/084 173/147 |
| 5,921,336 | A | 7/1999 | Reed | |
| 6,581,525 | B2 | 7/2003 | Smith | |
| 9,096,282 | B2 | 8/2015 | Smith | |
| 9,926,719 | B2 * | 3/2018 | Reddy | E21B 15/003 |
| 2018/0128056 | A1 * | 5/2018 | Gupta | E04H 12/345 |
| 2019/0041879 | A1 * | 2/2019 | Ross | B66F 19/00 |

* cited by examiner

*Primary Examiner* — Gregory W Adams
(74) *Attorney, Agent, or Firm* — Schwabe Williamson & Wyatt

(57) ABSTRACT

Some embodiments may include a drilling rig comprising base structure; a hoisting device to raise drill pipe into a position in which the drill pipe is aligned with a bore axis of a well, the hoisting device connected to the base structure and including a hoisting cable and a mast, the mast having an operating side and a back side opposite the operating side, wherein the operating side of the mast is configured to accept the drill pipe; and a drawworks operatively connected to the mast via the hoisting cable, wherein the drawworks is closer to the operating side of the mast than to the back side of the mast. Other embodiments may be disclosed and/or claimed.

32 Claims, 6 Drawing Sheets

(Background)

DRILLING RIG WITH DRAWWORKS PROXIMATE TO THE OPERATING SIDE OF THE MAST

RELATED APPLICATIONS

The present application claims priority to U.S. Provisional Patent Application Ser. No. 63/025,821, filed May 15, 2020, entitled: Drilling Module with Forward Mounted Drawworks, which is hereby incorporated by reference.

FIELD OF THE INVENTION

This disclosure relates generally to drilling rigs, and more particularly drilling rigs having a mast and drawworks.

BACKGROUND

Oil drilling rigs are large machines that are used to drill a hole in the ground into an underground reservoir of hydrocarbons. A drilling rig operator uses specialized machines to drill the hole, and perform other operations to retrieve the oil that is trapped in the underground reservoir. Different parts of the world present different challenges to drilling operations when attempting to access the underground oil. Undersea oil fields might require drill ships, floating oil platforms, or jackup drilling rigs. Oil fields in swamps may require drilling rigs that can operate on mud and soft soil, and the drilling rigs may have to disassemble into very small components to move between wells. In deserts, the drilling rigs may have to operate in high heat environments over soft sand. In the arctic, the extreme cold may make it difficult to do outdoor work in the winter. To address these different constraints, specialized machinery and drilling rig designs are required to work in different geographic areas.

In the arctic, trailer mounted or self-propelled drilling rigs are used to minimize the amount of manual labor that is required to move a drilling rig from well site to well site in the harsh environment. A traditional drilling rig might disassemble into fifty or more truck loads to move, while an Artic drilling rig might be configured to move in one to five modules. Each module might weight several million pounds. These large modules require roads and bridges to be built that are large enough to support them. Therefore, there is an advantage to build new drilling rigs that are physically as light as possible to move between wells while maintaining capacity to drill wells efficiently. In addition, the arctic environment makes the design of the drilling locations very costly. Most well sites have clusters of wells that are very close together to minimize the cost of construction of the drilling site. On small drilling sites, drilling rigs have limited space around each well to operate. The oil collection piping can provide additional access limitations. As a result of these challenges, many drilling rigs in the arctic are designed to back over a well location to drill. Normally the drilling loads, which can exceed one million pounds, are supported by setting the frame of the drilling rig onto the ground in front of the well and extending the drilling mast over the top of the well on a cantilevered platform. Some drilling rigs might include additional struts and jacks behind the rig to keep the rig from tipping backwards.

DETAILED DESCRIPTION

Figure 1:
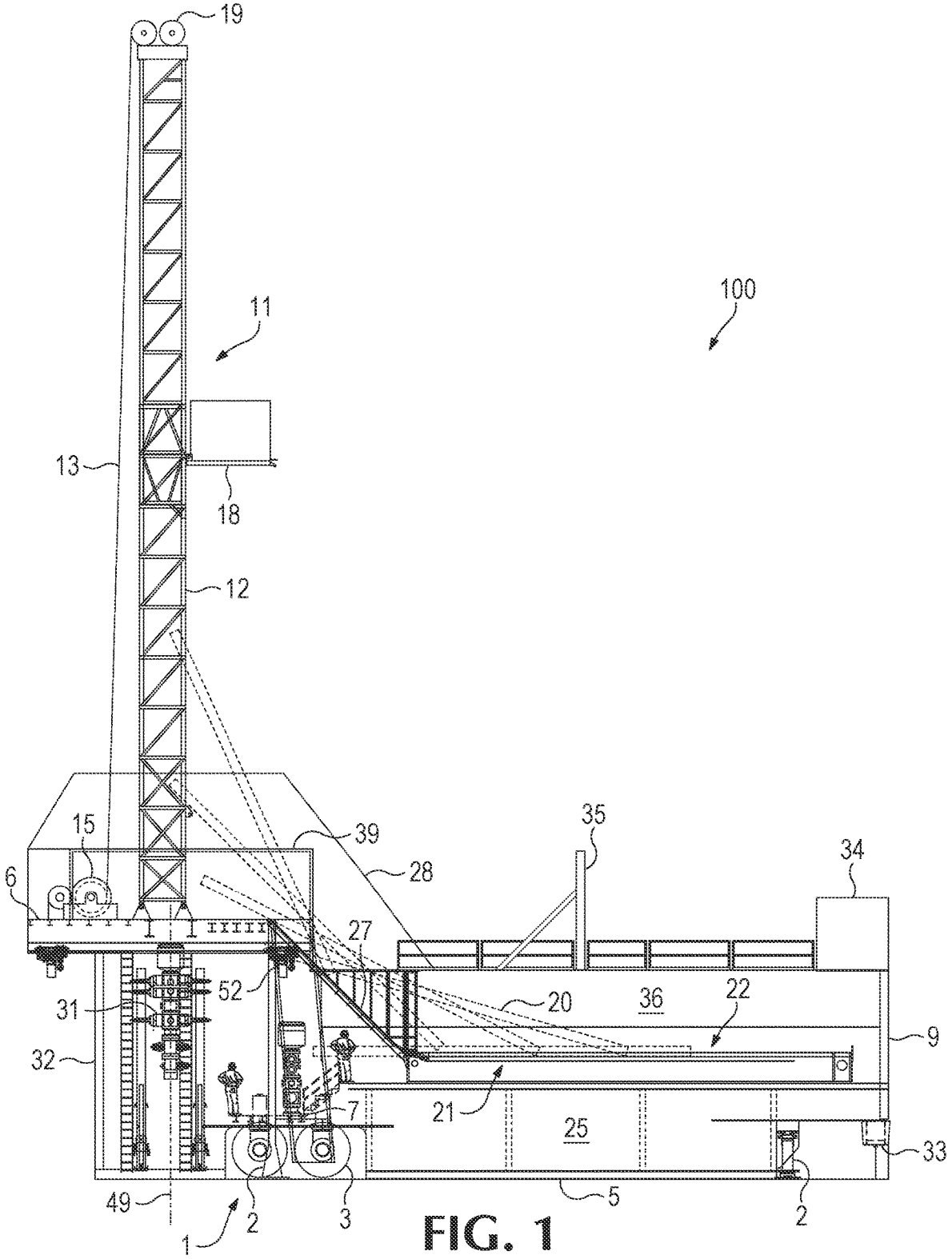
FIG. 1 shows a side view of a drilling rig.

When drilling rigs are trailer mounted, the drilling rigs are designed to have the proper weight distribution between the rear suspension of the trailer and the towing vehicle. The weight on the towing vehicle must be large enough to provide sufficient traction, but not so large as to overload the suspension of the towing vehicle. Specialized trucks are required to pull large trailer-mounted drilling rigs because of the extremely heavy loads on the towing vehicle. In order to achieve the required weight distribution under towing conditions while providing access to well-heads under drilling conditions, many trailer-mounted arctic drilling rigs have a sliding upper module (a "skidding rig floor") that the mast and other drilling equipment are mounted to. This sliding rig floor is slid backwards behind the trailer suspension during drilling in order to position the mast over the well-head, and slid forwards during towing in order to provide the correct weight distribution for the trailer and towing vehicle suspensions.

For trailer-mounted drilling rigs, obtaining an acceptable weight distribution is challenging since much of the heaviest machinery is normally installed behind the rear suspension. To balance this weight, extra equipment is often added to the front of the trailer or module as ballast (to add extra weight to the front to balance the entire structure). This weight increases the total weight of the structure, which makes moving drilling rigs from well site to well site more challenging.

In some embodiments described herein, structural framing of the trailer is extended behind the rear suspension to either side of the well. This additional framing provides support for the drilling loads from the mast and rig floor directly down into the ground to either side of the well. In traditional trailer mounted arctic drilling rigs, these loads are supported on a structure cantilevered off the back of the trailer and tend to tip the trailer backwards. Some embodiments herein may allow a much lighter overall construction by transferring the drilling loads down into the operating surface more directly. Also, because some embodiments described herein do not require a sliding rig floor, additional support struts and beams, or the use of extra actuators and equipment required to move the drilling rig floor back and forth is minimized, cost and weight may be further reduced.

The most commonly recognized parts of a drilling rig is the mast or derrick. The mast is the vertical structure for a tall vertical crane that is used to lower drill bits, drilling pipe, well casing and other tools into a well. While drilling as the well becomes deeper, additional pieces of drill pipe are connected in series to extend the length of the drill string into the well. One of the largest pieces of equipment that is mounted on a drilling structure is called the drawworks. The drawworks is a large winch that is used to raise and lower the crane hook on the mast. On a large drilling rig, the drawworks may weigh over one hundred thousand pounds. The "fast line" or the drilling line refers to the wire rope between the drawworks drum, and the top of the mast. Normally the drawworks is located as close to the mast as possible, so that the line is as close to vertical as possible to minimize lateral loads into the mast. Larger lateral loads require a stronger, heaver, and thus more expensive mast.

FIG. 1 illustrates a side view of a known drilling rig 100. The drilling rig 100 includes a base structure 5 to support the drilling rig 100 above an operating surface (the bottom of the base structure 5 may be in contact with the operating surface, or the bottom of the base structure 5 may be non-contacting the operated surface if the base structure 5 is on one or more lifting devices 2 on the operating surface), and a hoisting device 11 to raise drill pipe 20 into a position in which the drill pipe 20 is aligned with a bore axis of a well at well center line 49. The hoisting device 11 is connected to a raised platform 6 (also referred to as the drill floor) and includes a mast 12, a hoisting cable 13, and one or more pulley(s) 19 on an upper section of the mast 12. In this example, the pulley(s) 19 are located at the "crown" of the mast 12, but in other examples these pulley(s) 19 may be located in some other part of an upper section of the mast 12. The mast 12 includes an operating side to accept the drill pipe 20 and a rear side opposite the operating side.

In this drilling rig 100, the drawworks 15 is also located on the raised platform 6 as close to the mast 12 as possible, so that the hoisting cable 13 is vertically-oriented to minimize lateral loads on the mast 12. The driller's cabin and the tool house 39 are located to either side of the mast. The tool house 39 may be used to store tools for the drilling crew to use on the drill floor 6, while the primary functions of the drilling rig 100 are normally controlled from the driller's cabin. There is still a lateral load applied to the mast 12 since the hoisting cable is not completely vertical, so the mast 12 must be designed to withstand that lateral load. Besides the contribution this makes to the total build cost of the mast 12, this also increases the weight of the mast 12. The added weight on the back end of the drilling rig 100 may need to be counterbalanced in some applications by adding ballast (not shown) to a front end of the drilling rig 100 and/or a pull truck (not shown) that may be connected to the front end of the drilling rig 100.

Moving extremely heavy loads has generally been a complicated task because the large forces involved in lifting and transporting the heavy loads. When possible, large loads are often transported by disassembling or breaking up the load into multiple smaller loads. However, this break-down and subsequent reassembly process can be very time consuming, especially when a heavy load is only moved a small distance or needs to be repositioned.

For heavy loads that need periodic movement or adjustment, devices commonly referred to as "walking machines" or "walkers" were developed. These machines typically move the heavy loads over small distances in incremental stages. Walking machines are particularly useful for moving large structures, such as oil rigs, which often times need to be moved in order to properly position them over pre-drilled wells in oil fields or moved to a new location that is undergoing oil exploration.

Instead of using wheels driven by rotational forces to move heavy loads, walking machines typically use hydraulic lift cylinders to lift the load above a supporting surface, and then move or rotate the load relative to the supporting surface by transporting the load via rollers or tracks in the walking machines. U.S. Pat. Nos. 5,921,336 and 6,581,525 show two methods of using walking machines to move heavy loads, such as oil rig structures.

Figure 2:
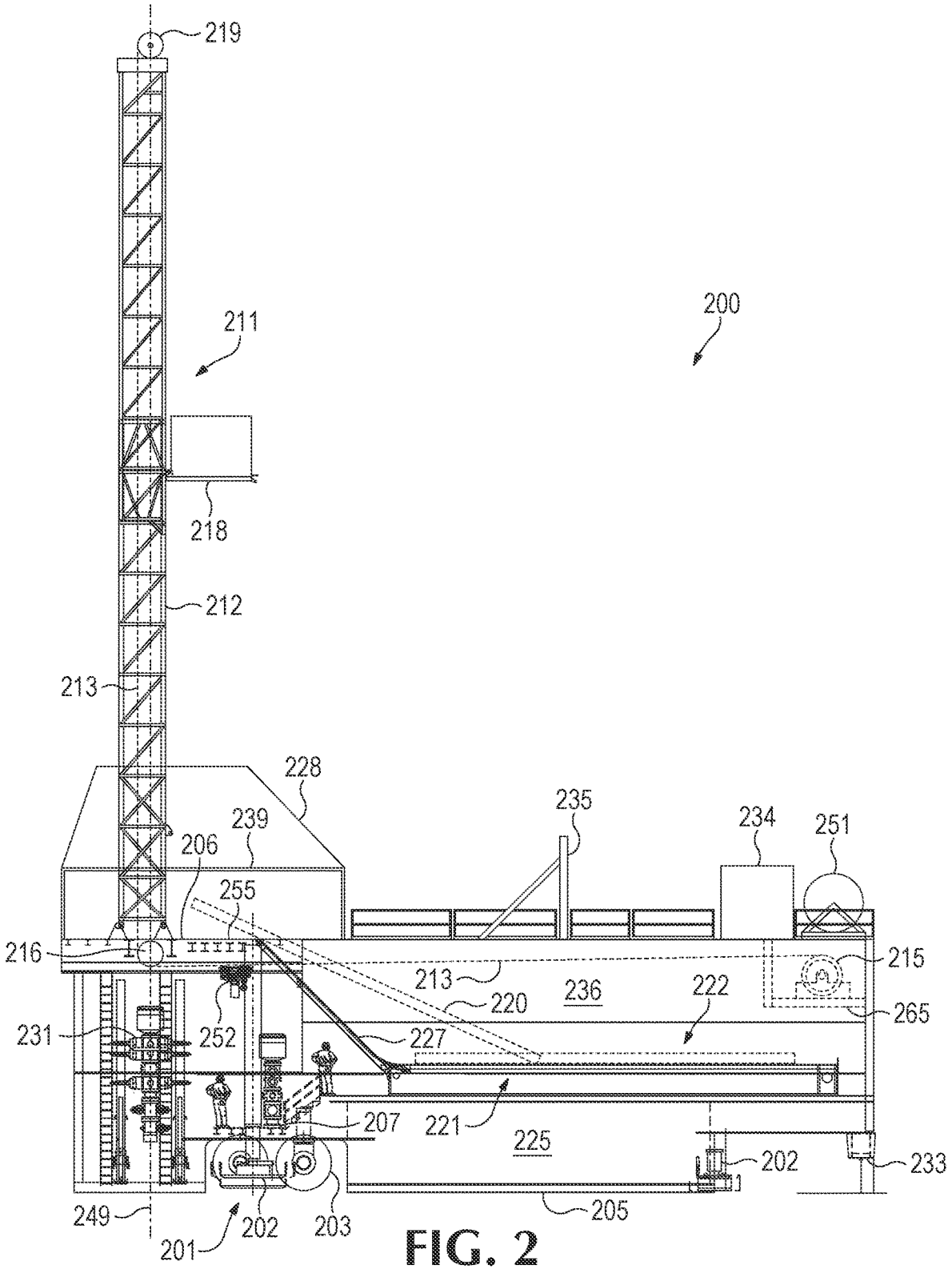
FIG. 2 shows a side view of a drilling rig with a forward-mounted drawworks, according to various embodiments.

The drilling rig 100 includes a transportation system 1 attached to the base structure 5, and this transportation system 1 may include both walking devices (not shown) and wheels 3. Referring briefly to FIG. 2, walking devices 202 are shown. Referring back to FIG. 1, walking devices may be used to move the drilling rig 100 short distances without a pull truck (not shown), say from one well to another well at an operating site. The wheels 3 may be used in combination with a pull truck attached to the kingpin 33 at the front end 9 to move the drilling rig 100 longer distances, say initial movement to the operating site with the wells. The design of the mast 12 and the need for any counter weight (ballast) all contribute to the weight of the drilling rig 100, which may necessitate a more expensive transportation system 1 and/or more expensive pull track (or even more expensive bridge) than might otherwise be needed.

Although the mast 12 is shown in the raised position, it may also be lowered onto its side during transportation. In the lowered position, the base of the mast 12 may remain on raised platform 6 the operating side of the mast 12 may contact the support 35 (which is also referred to as a headache rack). The mast 12 also may include a setback racking board 18. The windwalls 28 may open for lowering the mast 12.

The drilling rig 100 includes a pipe room 36 in which the pipe machine 21 is located. The pipe machine 21 has a pipe door opening 22 and a V-door 27 to route the drill pipe 20 to the mast 12. Machine rooms 25 are located below the pipe room 36. An air heater 34 is located above the pipe room 36.

Various other illustrated details of the drilling rig 100 will be familiar to those in the field. The drilling rig 100 may include a rig cellar 32 below the drill floor 6. A blow out preventer (BOP) 31 and a BOP crane 52 may be located in the rig cellar 32. A BOP stump 7 is shown over the rear suspension.

FIG. 2 illustrates a side view of a drilling rig 200 with a forward-mounted drawworks 215, according to various embodiments. The hoisting cable 213 extends from the drawworks 215 above the pipe machine 221 to the additional pulley 216 (e.g., a diverter pulley, which is also referred to as a diverter sheave).

The additional pulley 216 changes a direction of the hoisting cable 213 between the drawworks 215 and the pulley(s) 219. The hoisting cable 213 of the hoisting device 211 may extend to the pulley(s) 219 more vertically than the hoisting cable 13 (FIG. 1) extends to the pulley(s) 19 (FIG. 1). Other differences can be seen by comparing FIGS. 1 and 2—in FIG. 1, the hoisting cable 13 is located behind the rear of the mast 13, but in FIG. 2 the hoisting cable 213 is located to the side of the mast 212 (this is also indicated in FIG. 5B where a location 375 for the additional pulley 216 is shown to one side of the drilling rig 200).

Referring again to FIG. 2, given that the hoisting cable 213 may extend to the pulley(s) 219 more vertically than the hoisting cable 13, there may be less lateral load applied to the mast 212 than there is applied to mast 12 (FIG. 1). Due to the reduced lateral load, mast 212 may be different (e.g., lighter and/or less costly) than mast 12 (FIG. 1).

The drawworks 215 may be similar to the drawworks 15 in any regard. For example, the drawworks 215 may weigh fifty thousand pounds or more. The placement of this weight away from the rear of the drilling rig 200 improves the weight distribution of the drilling rig 200 without increasing the total weight. In some embodiments, shifting the weight forward may allow the drilling rig 200 to move with the mast 212 upright in the drilling position in some applications, rather than in a horizontal lowered position. For example, the drilling rig 200 may make use of the walking devices 202 to move short distances from well to well on a drilling site without a towing vehicle. The placement of the drawworks 215 forward in the drilling rig 200 better balances the drilling rig 200 while in the drilling configuration and while walking the drilling rig 200 from well to well on a drilling site. Many drilling rigs store pieces of drill pipe temporarily in the mast during certain operations to improve efficiency. This drill pipe might weight over five hundred thousand pounds and is known as "the setback," and may be located behind the rearmost walking device 202. By placing the drawworks 215 forward (e.g., in front of the rearmost walking device 202 and/or in front of the frontmost walking device 202), the drawworks 215 may help to balance the weight of the setback while walking between wells on a drill site.

A drilling line spool 251 may also be forward-mounted, which may further improve weight distribution. In this example, the drilling line spool 251 is located above the drawworks 215, although this is not required. The drilling line spool 251 may store additional drilling line, so that as the drilling line (e.g., hoisting cable 213) wears or fatigues, it can be easily replaced by releasing the drilling line anchor clamp and pulling additional drilling line off the drilling line spool 251. In this example, the air heater 234 is located behind the drilling line spool 251.

The mast 212 may be similar to the mast 12 in other regards (it may be configured to be lowered into a lowered position onto support 235—which may be similar to support 35 of FIG. 1). The mast 212 may have a setback racking board 218 similar to setback racking board 18, configured to support the upper portion of the drill pipe 220 while standing vertically on drill floor 206 at location 255.

The transportation system 201 and its individual components, including the walking devices 202 and the wheels 203, may function similarly as the transportation system 1 and its individual components. As noted already, in some applications it may be possible and practical to move the drilling rig 200 with the mast 212 in the raised position due to the differences between drilling rig 200 and drilling rig 100. Although the functions may be similar, the cost and weight of the various individual components may be reduced by the improved weight distribution discussed above (and/or due to a reduced need for ballast, e.g., less total weight, in various applications).

The pipe shed 236 may be similar to the pipe shed 36 (FIG. 1), but may include a shelf/platform 265 to support the drawworks 215 as illustrated. The arrangement of the additional pulley 216 at the location 375 (FIG. 5B) to the side of the mast 212 routes the hoisting cable 213 leaving space so that it does not interfere with the drilling pipe 220 and other tubulars that are lifted from the pipe machine 221 in the pipe room 236 into the derrick. In the disclosed arrangement, the hoisting cable 213 runs below the drill floor 206 and is redirected up into the crown of the mast 212 near well center 249. Therefore, the pipe door opening 222 and the V-door 227 may operate the same as the pipe door opening 22 and V-door 27 (FIG. 1) even though the hoisting cable 213 runs through the pipe room 236.

In this example, the additional pulley 216 may be connected to the base structure 205 (which may be similar to base structure 5 of FIG. 1) at the location 375 (FIG. 5B). In other examples, it may be possible and practical to mount the additional pulley 216 to a lower section of the mast 212.

The windwalls 228 and the V-door 227 may be similar to the windwalls 28 and the V-door 27 (FIG. 1). The tool house 239 may be similar to the tool house 39 (FIG. 1), although the freed-up space in the rear may be used for different equipment and/or operations. The machinery rooms 225 may be similar as the machinery rooms 25 (FIG. 1), and a rig cellar may be similar to rig cellar 32 (FIG. 1). The kingpin 233 may be similar to the kingpin 33 (FIG. 1), a BOP 231, BOP crane 252, and BOP stump 207, may be similar to the BOP 31 and the BOP crane 52 (FIG. 1), respectively, etc.

Figure 3:
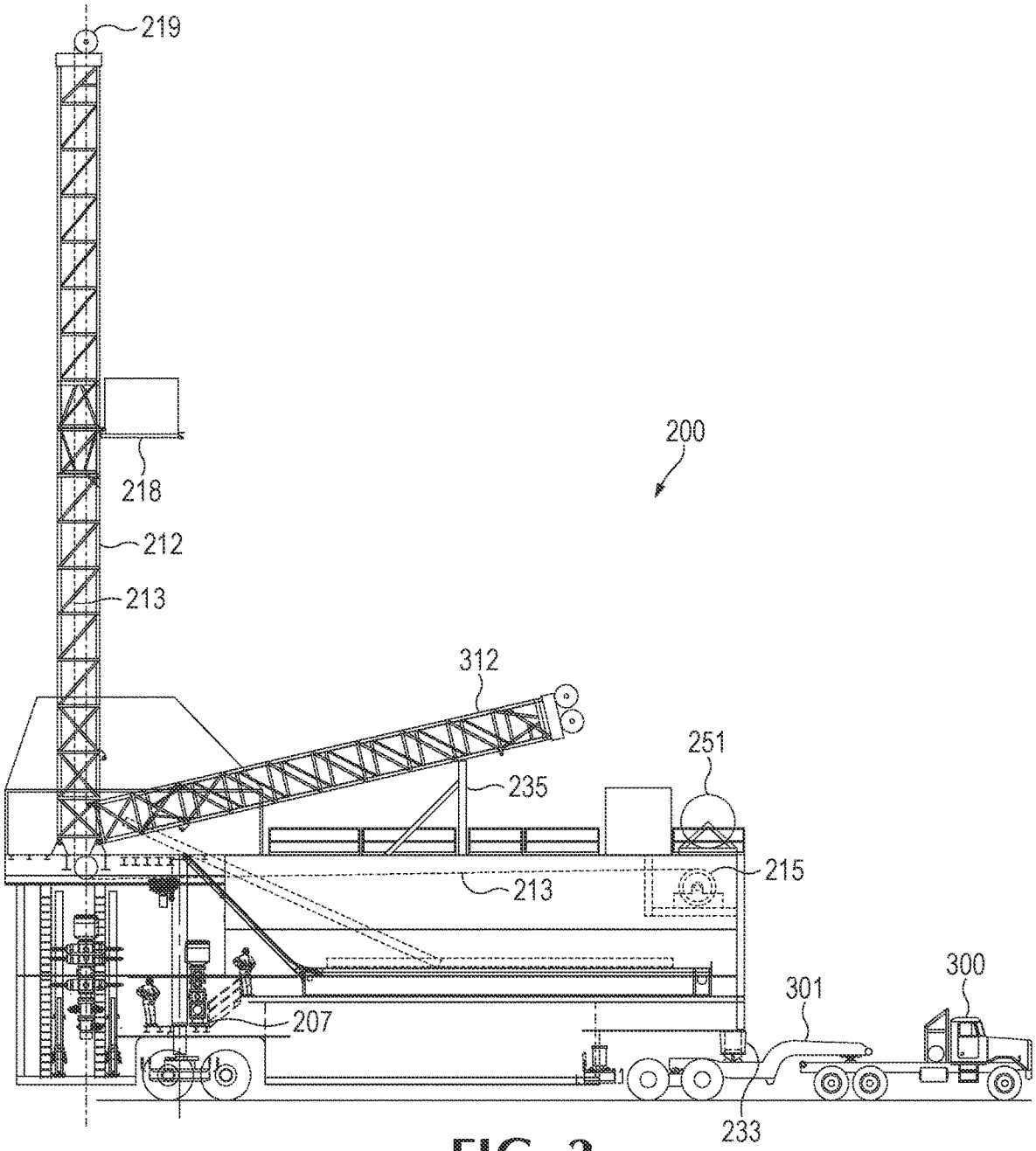
FIG. 3 shows a side view of the drilling rig of FIG. 2 in which the front end of the drilling rig is attached to a pull truck, according to various embodiments.

FIG. 3 shows a side view of the drilling rig 200 of FIG. 2 in which the front end of the drilling rig 200 is attached to a pull truck 300, according to various embodiments. A load divider 301 is used in this embodiment, although it is not required to use the pull truck 300 in some other embodiments. In embodiments in which the pull truck 300 is used, any weight reductions from the mast 212 may reduce the required towing specifications for the pull truck 300.

Figure 4:
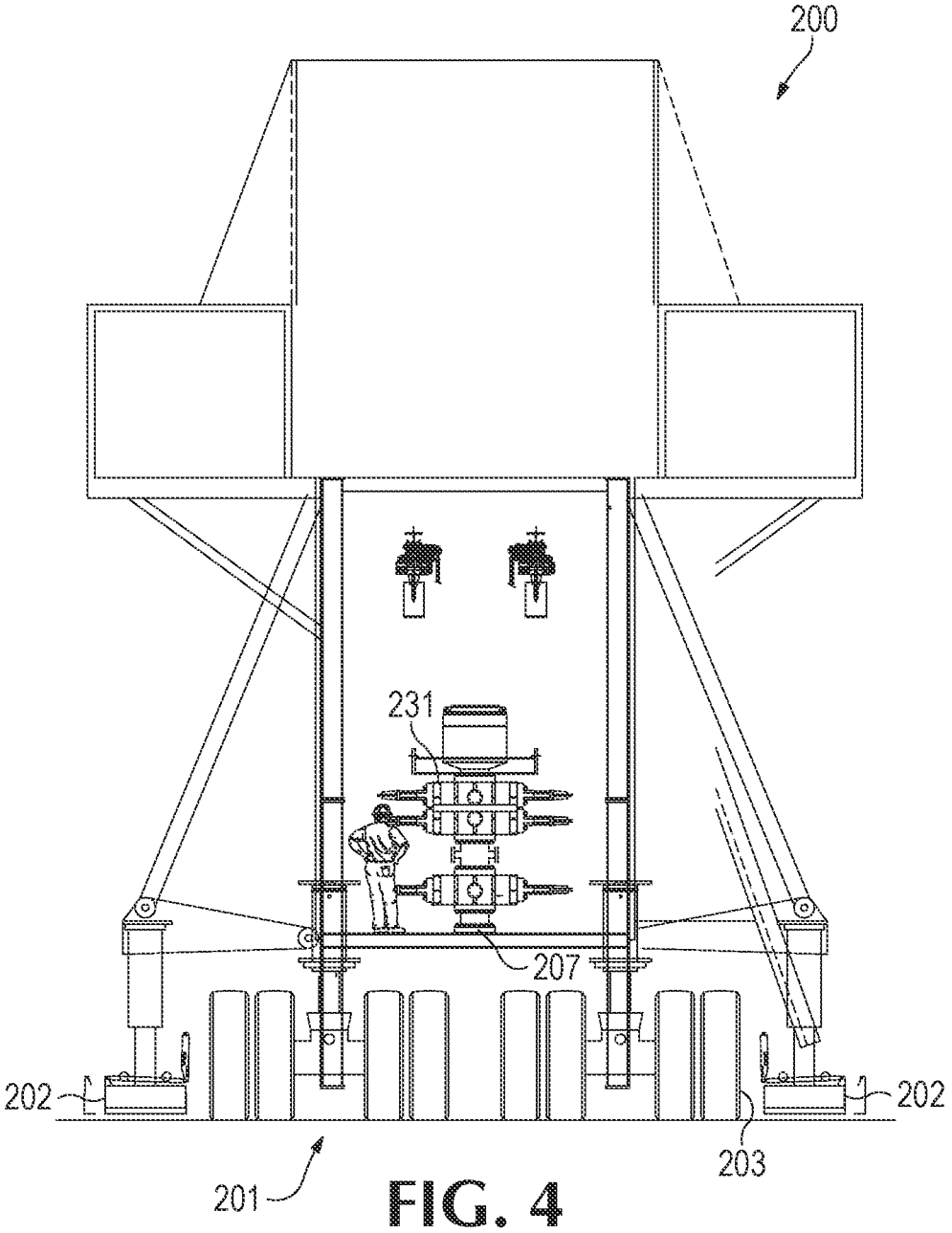
FIG. 4 shows a section view of the drilling rig of FIG. 2 taken along a line intersecting the bop stump, according to various embodiments.

FIG. 3 also shows an illustration of a lowered position 312 of the mast 212. The lowered position 312 can be used for maintenance and/or for transport. In the lowered position 312 the operating side of the mast 212 is supported by the support 235. Also, in this example, the mast 212 can be shortened prior to lowering it into the lowered position, although this is not required (in some examples, the crown of the mast 212 may extend all the way over the pull truck 300). FIG. 4 shows a section view of the drilling rig 200 of FIG. 2—in which the BOP 231 is in transport position—taken along a line intersecting the BOP stump 207 (FIG. 2), according to various embodiments.

Figure 5A:
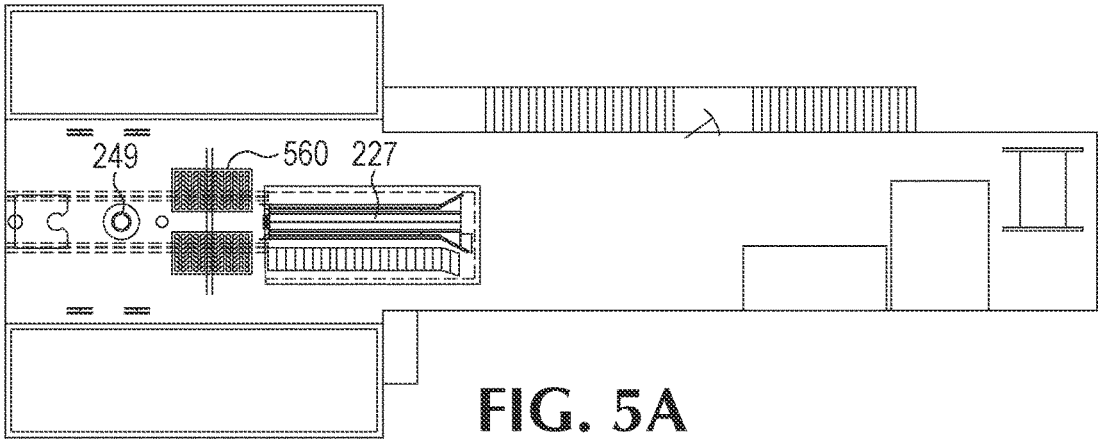
FIG. 5A illustrates an upper level plan view of the drilling rig of FIG. 2, according to various embodiments.
Figure 5B:
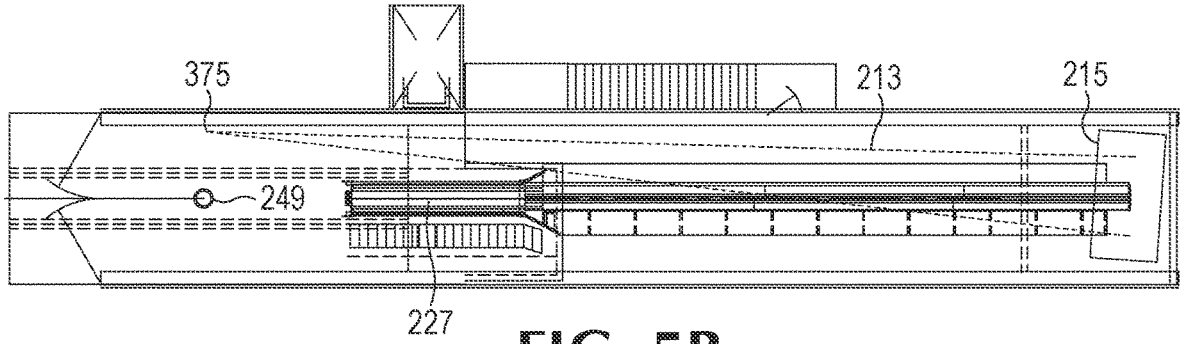
FIG. 5B illustrates a pipe room plan view of the drilling rig of FIG. 2, according to various embodiments.

FIG. 5A illustrates an upper level plan view of the drilling rig 200 of FIG. 2, according to various embodiments. A setback location 560 indicates where the multiple pieces of drill pipe 220 (FIG. 2) are stored vertically in the mast 212 (FIG. 2).

FIG. 5B illustrates a pipe room plan view of the drilling rig 200 of FIG. 2, according to various embodiments. The hoisting cable 213 moves side to side in the range as indicated by the dashed lines as it unspooled from the drawworks 215. This path of travel is kept out of the way of the drill pipe 220 received by the operating side of the mast 212. In this example, the drawworks 215 is canted with respect to the base of the mast 212, although this is not required.

Figure 5C:
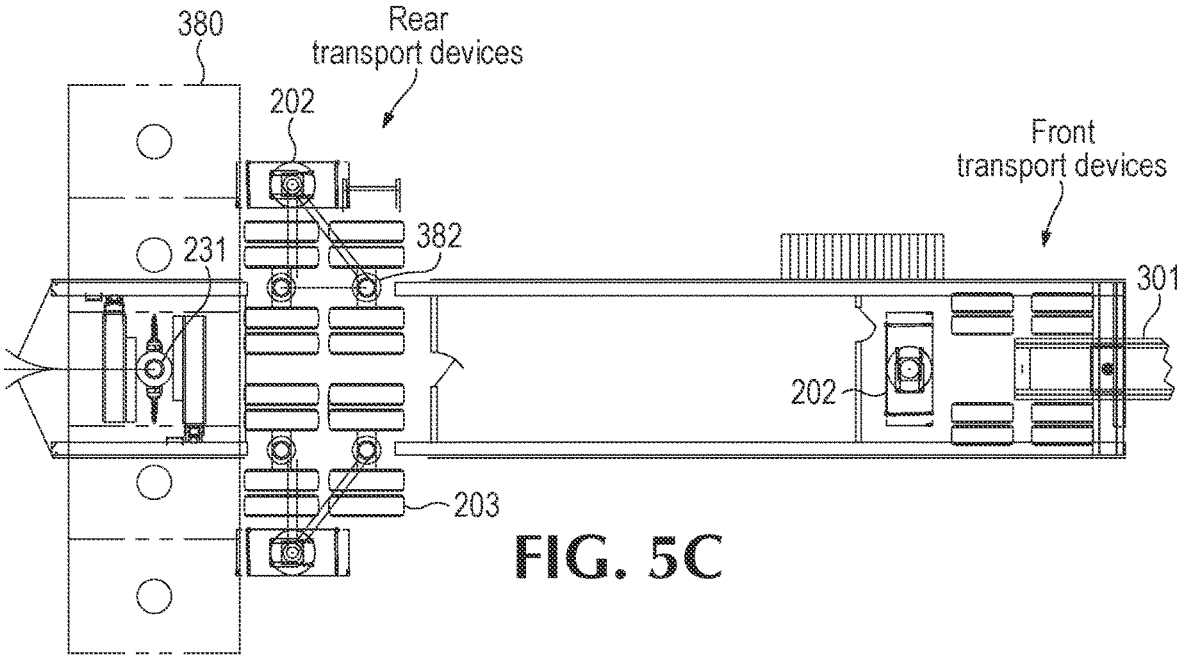
FIG. 5C illustrates a lower plan view of the drilling rig of FIG. 2, according to various embodiments.

FIG. 5C illustrates a lower plan view of the drilling rig of FIG. 2, according to various embodiments. A hydraulic suspension 382 to raise and lower the base structure 205 (FIG. 2) can be seen in this view. A wells enclosure 380 and the BOP 231 are also illustrated in this view.

Figure 6:
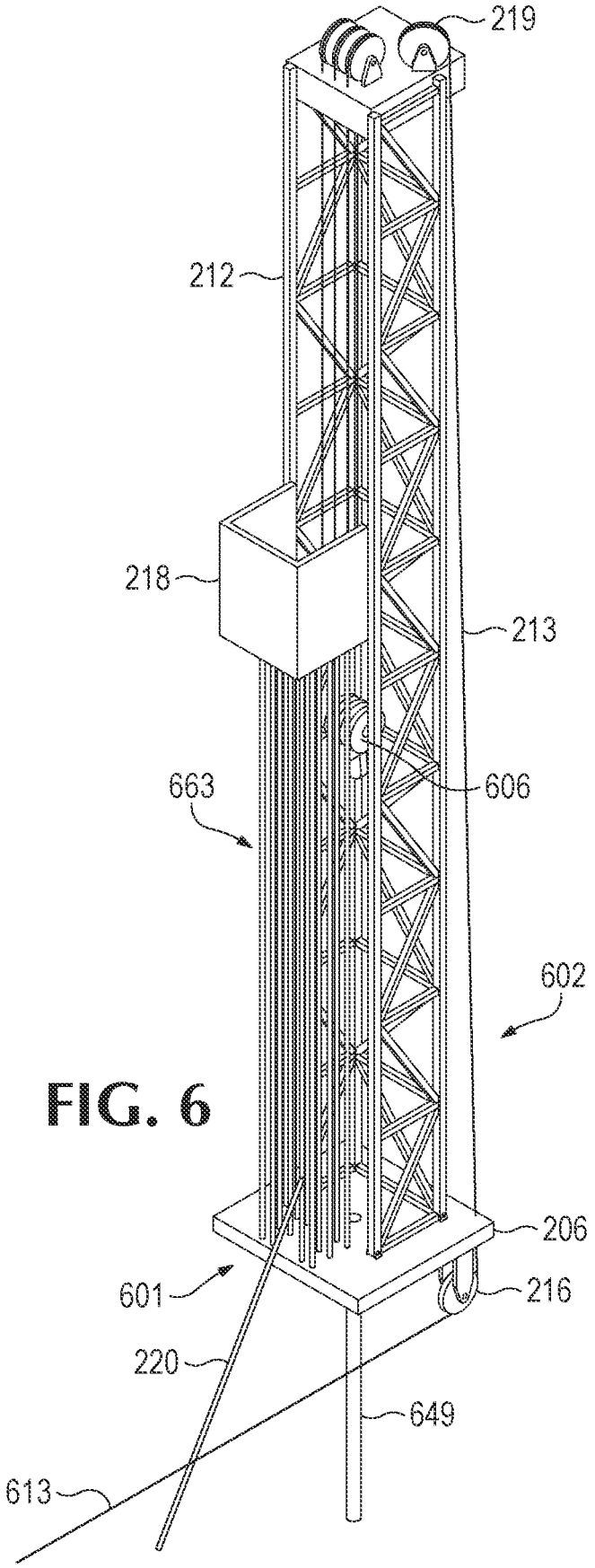
FIG. 6 illustrates an isometric view of the mast of FIG. 2, according to various embodiments.

FIG. 6 illustrates an isometric view of the mast 212 of FIG. 2, according to various embodiments. The mast 212 includes an operating side 601 and a back side 602 opposite the operating side 601. The operating side 601 includes an opening to accept the drill pipe 220 (for raising into the position in which the drill pipe 220 is aligned with a bore axis of the well 649). A setback 663 of the drill pipe 220 is also located on the operating side 601 below the setback racking board 218.

The additional pulley 216 is shown on a side of sides of the mast 212, which routes the hoisting cable 213 (e.g., the drilling line 613 or "fast line" of the hoisting cable 213) leaving space so that it does not interfere with the drilling pipe 220 and other tubulars that are lifted from the pipe machine 221 (FIG. 2) in the pipe room 236 (FIG. 2) into the operating side 601 of the mast 212. The hoisting cable 213 between pulley 216 and pully(s) 219 may be more vertical than the hoisting cable 13 (FIG. 1).

The opening in the operating side 601 of the mast 212 also provides space for movement of traveling block 606, which is operatively coupled to the hoisting cable 213. The traveling block 606, or any other individual component of the hoisting device 211 and/or the drilling rig 200 (FIG. 2) may include any of the features any of the individual components described in U.S. Pat. No. 9,096,282, which is incorporated by reference herein.

Various embodiments of drilling rigs utilizing any of the features described herein may include a drawworks mounted closer to an operating side of a mast than the opposite side of the mast. In various embodiments, the drilling rigs may include transportation systems, although this is not required.

In embodiments with transportation systems, the drawworks may be located closer to a front end of the drilling rig than the mast. Also, in these embodiments a base of the mast may be located behind at least one of one or more rear transport devices of the transportation system, and the drawworks may be located in front of the at least one of the one or more rear transport devices. These embodiments may be trailer-mounted or self-propelled.

In drilling rigs without transportation systems, the mounting of the drawworks close to the operating side of the mast may better distribute weight than drilling rigs with conventionally mounted drawworks, or may allow the drawworks to be located on the operating surface (thereby reducing the load on the base structure). Where the drawworks is mounted to the base structure, the mast and the drawworks may be located on opposite sides of the base structure. Where the drilling rig includes a pipe handling machine, the drawworks may be located on a same side of the mast as the pipe handling machine, and the drilling rig may include a drill pipe delivering space located between the operating side of the mast and the pipe handling machine (like the drawworks, the pipe handling machine may be connected to the base structure as in the illustrated example, or located on the operating surface or a separate vehicle). Also, the use of an additional pulley as described herein may reduce lateral loads on the mast, which may be advantageous even in drilling rigs without transportation systems.

In various embodiments, the mast may be located on a raised platform, and the hoisting cable may run below a level of the raised platform. However, this is not required. In some embodiments, the mast may be mounted to the base structure and the hoisting cable may run above or below a floor of the base structure. In these embodiments, an additional pulley may be mounted on the floor of the base structure or to a lower section of the mast. In these embodiments, the hoisting cable may extend more vertically than the hoisting cable in embodiments in which the drawworks is located behind the rear side of the mast.

References above have been made in detail to preferred embodiment. Examples of the preferred embodiments were illustrated in the referenced drawings. While preferred embodiments where described, it should be understood that this is not intended to limit the invention to one preferred embodiment. To the contrary, it is intended to cover alternatives, modifications, and equivalents as may be included within the spirit and scope of the invention as defined by the appended claims.

Having described and illustrated the principles of the invention in a preferred embodiment thereof, it should be apparent that the invention may be modified in arrangement and detail without departing from such principles. Claim is made to all modifications and variation coming within the spirit and scope of the following claims.

The invention claimed is:

1. A drilling rig, comprising:

a base structure having a front end, wherein the front end supports a drawworks;

a hoisting device to raise drill pipe into a position in which the drill pipe is aligned with a bore axis of a well, the hoisting device connected to the base structure and including a hoisting cable and a mast or derrick, the mast or derrick having an operating side and a back side opposite the operating side, wherein the operating side of the mast or derrick is an only side of the mast or derrick configured to accept the drill pipe from a horizontal position to a vertical position; and the drawworks operatively connected to the mast or derrick via the hoisting cable, wherein the operating side of the mast or derrick faces the front end of the base structure, and wherein 1) the drawworks and 2) one or more front lift or transport devices configured to lift or transport, respectively, the front end of the base structure are both closer to the operating side of the mast or derrick than to the back side of the mast or derrick.

2. The drilling rig of claim 1, further comprising a transportation system operatively coupled to the base structure, wherein the transportation system comprises the one or more front lift or transport devices and one or more rear lift or transport devices located towards a rear end of the drilling rig and configured to lift or transport, respectively, the rear end of the drilling rig, and wherein the transportation system is configured to position the drilling rig over the well.

3. The drilling rig of claim 2, wherein the transportation system includes a plurality of walking devices.

4. The drilling rig of claim 2, wherein the transportation system includes a plurality of wheels.

5. The drilling rig of claim 2, wherein the transportation system includes a plurality of walking devices and a plurality of wheels, wherein the transportation system is operable in a first mode using the wheels with the walking devices raised above an operating surface, wherein the transportation system is operable in a second mode using the walking devices.

6. A drilling rig, comprising:

a base structure;

a hoisting device to raise drill pipe into a position in which the drill pipe is aligned with a bore axis of a well, the hoisting device connected to the base structure and including a hoisting cable and a mast or derrick, the mast or derrick having an operating side and a back side opposite the operating side, wherein the operating side of the mast or derrick is configured to accept the drill pipe; and a drawworks operatively connected to the mast or derrick via the hoisting cable, wherein the drawworks is closer to the operating side of the mast or derrick than to the back side of the mast or derrick;

a transportation system operatively coupled to the base structure, wherein the transportation system comprises one or more front lift or transport devices located towards a front end of the drilling rig and configured to lift the front end of the drilling rig and one or more rear lift or transport devices located towards a rear end of the drilling rig and configured to lift the rear end of the drilling rig, wherein the hoisting device is behind at least one of the one or more rear lift or transport devices, wherein the drawworks is located in front of the at least one of the one or more rear lift or transport devices.

7. The drilling rig of claim 1, wherein the mast is pivotable, the drilling rig further comprising a support structure connected to the drilling rig located in front of a base of the pivotable mast, wherein the support structure is configured to receive the operating side of the pivotable mast when the pivotable mast is pivoted into a lowered position.

8. The drilling rig of claim 7, further comprising a pipe handling machine to provide the drill pipe, wherein the pipe handling machine is closer to the operating side of the pivotable mast than the back side of the pivotable mast, and wherein the pipe handling machine is underneath the pivotable mast when the pivotable mast is in the lowered position.

9. The drilling rig of claim 8, further comprising a space to deliver the drill pipe to the pivotable mast, the drill pipe delivering space located between the operating side of the pivotable mast and the pipe handling machine.

10. The drilling rig of claim 1, wherein the drawworks is canted with respect to the mast or derrick.

11. The drilling rig of claim 1, further comprising a drilling line spool mounted above the drawworks or proximate to the drawworks.

12. The drilling rig of claim 1, wherein the drilling rig further comprises a setback located in front of the operating side of the mast or derrick, wherein the drawworks is located in front of the setback.

13. The drilling rig of claim 6, wherein the drilling rig further comprises a raised platform connected to the base structure by a support structure, wherein the mast or derrick is connected to the raised platform.

14. The drilling rig of claim 6, wherein the drawworks is connected to the base structure.

15. The drilling rig of claim 6, further comprising a pipe handling machine to provide the drill pipe, wherein the pipe handling machine is closer to the operating side of the mast or derrick than the back side of the mast or derrick.

16. The drilling rig of claim 15, wherein at least part of the pipe handling machine is located in front of the at least one of one or more rear lift or transport devices.

17. A drilling rig, comprising:

a base structure;

a hoisting device to raise drill pipe into a position in which the drill pipe is aligned with a bore axis of a well, the hoisting device connected to the base structure and including a hoisting cable and a mast or derrick, the mast or derrick having an operating side and a back side opposite the operating side, wherein the operating side of the mast or derrick is configured to accept the drill pipe; and a drawworks operatively connected to the mast or derrick via the hoisting cable, wherein the drawworks is closer to the operating side of the mast or derrick than to the back side of the mast or derrick;

a transportation system operatively coupled to the base structure, wherein the transportation system comprises one or more front lift or transport devices located towards a front end of the drilling rig and configured to lift the front end of the drilling rig and one or more rear lift or transport devices located towards a rear end of the drilling rig and configured to lift the rear end of the drilling rig, and wherein at least part of the drawworks is located in front of at least one of the one or more front lift or transport devices.

18. The drilling rig of claim 1, wherein the hoisting device further comprises one or more pulleys located on an upper portion of the mast or derrick;

wherein the apparatus further comprises an additional pulley located below the one or more pulleys, the additional pulley to change a direction of the cable between the drawworks and the one or more pulleys, while the mast or derrick is in position to lift the drill pipe;

wherein the additional pulley is attached to a lower section of the mast or derrick or is attached to the base structure proximate to a base of the mast or derrick.

19. The drilling rig of claim 18, wherein the additional pulley is located closer to one side of the drilling rig.

20. A drilling rig, comprising:

a base structure;

a hoisting device to raise drill pipe into a position in which the drill pipe is aligned with a bore axis of a well, the hoisting device connected to the base structure and including a hoisting cable and a mast or derrick, the mast or derrick having an operating side and a back side opposite the operating side, wherein the operating side of the mast or derrick is configured to accept the drill pipe; and a drawworks operatively connected to the mast or derrick via the hoisting cable, wherein the drawworks is closer to the operating side of the mast or derrick than to the back side of the mast or derrick;

wherein:

the drawworks is canted with respect to the mast or derrick, or the drilling rig further comprises:

a drilling line spool mounted proximate to the drawworks, or a pipe handling machine to provide the drill pipe, wherein the pipe handling machine is closer to the operating side of the mast or derrick than the back side of the mast or derrick, and wherein the pipe handling machine is underneath the mast or derrick when the mast or derrick is in the lowered position, in which a space to deliver the drill pipe to the mast or derrick is located between the operating side of the mast or derrick and the pipe handling machine.

21. The drilling rig of claim 20, wherein the drawworks is connected to the base structure.

22. The drilling rig of claim 20, wherein the pipe handling machine is closer to the operating side of the mast or derrick than the back side of the mast or derrick.

23. The drilling rig of claim 22, wherein at least part of the pipe handling machine is located in front of at least one of one or more rear lift or transport devices configured to lift or transport, respectively, a rear end of the base structure.

24. The drilling rig of claim 20, wherein the drilling rig further comprises a raised platform connected to the base structure by a support structure, wherein the mast or derrick is connected to the raised platform.

25. The drilling rig of claim 20, wherein the hoisting device further comprises one or more pulleys located on an upper portion of the mast or derrick;

wherein the apparatus further comprises an additional pulley located below the one or more pulleys, the additional pulley to change a direction of the cable between the drawworks and the one or more pulleys, while the mast or derrick is in position to lift the drill pipe;

wherein the additional pulley is attached to a lower section of the mast or derrick, or is attached to the base structure proximate to a base of the mast or derrick.

26. The drilling rig of claim 25, wherein the additional pulley is located closer to one side of the drilling rig.

27. The drilling rig of claim 20, wherein the mast is pivotable, the drilling rig further comprising a support structure connected to the drilling rig located in front of a base of the pivotable mast, wherein the support structure is configured to receive the operating side of the pivotable mast when the pivotable mast is pivoted into a lowered position.

28. The drilling rig of claim 27, wherein the pipe handling machine is closer to the operating side of the pivotable mast than the back side of the pivotable mast, and wherein the pipe handling machine is underneath the pivotable mast when the pivotable mast is in the lowered position.

29. The drilling rig of claim 20, wherein the operating side of the mast or derrick defines an opening that is not present on the rear side of the mast or derrick.

30. A drilling rig, comprising:

a base structure supporting a pipe handling machine, the pipe handling machine to provide drill pipe;

a hoisting device to raise the drill pipe into a position in which the drill pipe is aligned with a bore axis of a well, the hoisting device connected to the base structure and including a hoisting cable and a mast or derrick, the mast or derrick having an operating side and a back side opposite the operating side, wherein the operating side of the mast or derrick is an only side of the mast or derrick configured to accept the drill pipe from a horizontal position to a vertical position; and wherein the operating side of the mast or derrick is closer to the pipe handling machine than the back side of the mast or derrick, in which a space to deliver the drill pipe to the mast or derrick is located between the operating side of the mast or derrick and the pipe handling machine;

a drawworks operatively connected to the mast or derrick via the hoisting cable, wherein the drawworks is closer to the operating side of the mast or derrick than to the back side of the mast or derrick.

31. The drilling rig of claim 30, wherein the mast is pivotable wherein the pipe handling machine is underneath the mast when the pivotable mast is in a lowered position.

32. The drilling rig of claim 30, further comprising a transportation system operatively coupled to the base structure, wherein the transportation system includes one or more rear lift or transport devices closer to an operating side of the mast or derrick than the back side of the mast or derrick, the one or more rear lift or transport devices configured to lift or transport, respectively, a rear end of the base structure.

* * * * *